US006540540B1

(12) United States Patent
Tobey

(10) Patent No.: US 6,540,540 B1
(45) Date of Patent: Apr. 1, 2003

(54) MEMORY MODULE SOCKET WITH ATTACHABLE LATCHING APPENDAGES

(75) Inventor: Shawn Phillip Tobey, Trinity, NC (US)

(73) Assignee: Tyco Electronics Corporation, Wilmington, DE (US)

( * ) Notice: Subject to any disclaimer, the term of this patent is extended or adjusted under 35 U.S.C. 154(b) by 0 days.

(21) Appl. No.: 09/564,870

(22) Filed: May 4, 2000

(51) Int. Cl.[7] ..... H01R 13/62

(52) U.S. Cl. ..... 439/327; 439/157; 439/160; 439/567

(58) Field of Search ..... 439/160, 326, 439/327, 157, 325, 567

(56) References Cited

U.S. PATENT DOCUMENTS

| | | | | |
|---|---|---|---|---|
| 3,932,016 A | | 1/1976 | Ammenheuser | 339/65 |
| 5,145,395 A | | 9/1992 | Kuei Lai | 439/326 |
| 5,366,390 A | | 11/1994 | Kinross et al. | 439/636 |
| 5,383,792 A | | 1/1995 | Korsunsky et al. | 439/326 |
| 5,484,302 A | | 1/1996 | Yamada et al. | 439/326 |
| 5,690,499 A | | 11/1997 | Howell et al. | 439/157 |
| 5,779,494 A | | 7/1998 | Ito et al. | 439/326 |
| 5,836,780 A | | 11/1998 | Mizumura et al. | 439/326 |
| 5,863,213 A | | 1/1999 | Enomoto et al. | 439/326 |
| 5,913,700 A | | 6/1999 | Tobey et al. | 439/637 |
| 5,938,464 A | | 8/1999 | Ichimura et al. | 439/327 |
| 5,961,346 A | * | 10/1999 | Choy | 439/567 |
| 5,964,606 A | | 10/1999 | Choy | 439/160 |
| 5,997,330 A | | 12/1999 | Choy | 439/328 |
| 5,997,331 A | | 12/1999 | Tu | 439/328 |
| 6,012,952 A | * | 1/2000 | Choy et al. | 439/637 |
| 6,024,592 A | | 2/2000 | Pai et al. | 439/326 |

OTHER PUBLICATIONS

DIMM Sockets—SO DIMM Dual Read–Out Sockets for SDRAM and SGRAM—AMP Incorporated Publication, pp., 1 of 3 & 2 of 3.

SO (Small Outline) DIMM (DUAL0ln Memory Module) Sockets 144 Positions with 0.8–mm Centerline Spacing–AMP Application Specification 114–01114, Dec. 10, 1998 Rev A, pp. 1–8.

* cited by examiner

*Primary Examiner*—P. Austin Bradley
*Assistant Examiner*—Truc Nguyen

(57) ABSTRACT

A socket 10 is used to mount a memory module 2, such as a small outline dual in-line memory module, on a printed circuit board 4. The socket 10 includes a plurality of contacts 30 mounted in a housing 20 so that contact can be established with pads on opposite sides of a card included in the module 2 when the module is cammed into the a housing slot 22. Identical latches 40 are mounted on opposite ends 24, 26 of the housing 20. Each latch 40 includes a latch arm 41 that can be deflected in opposite directions with latching surfaces 46, 47 on opposite sides, so that the same latch configuration can be used on either end. A floating solder foot 60 is mounted on each latch 40 so that the latch 40 can be soldered to the printed circuit board 4 with no concern for misalignment or stresses induced by warpage of the socket 10 or the printed circuit board 4.

10 Claims, 6 Drawing Sheets

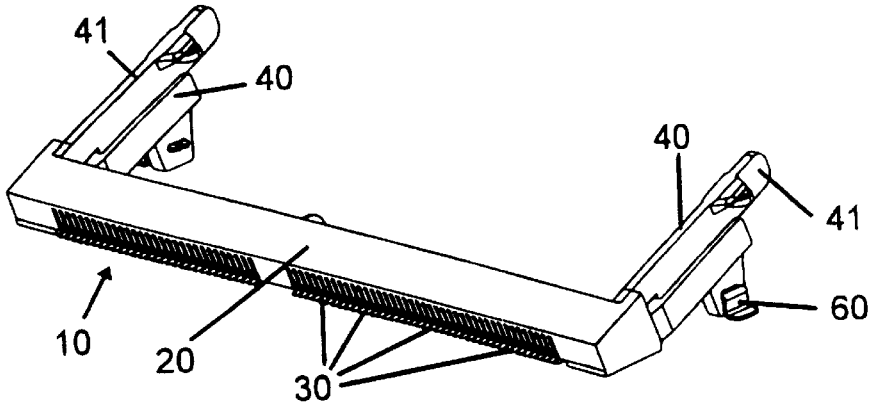
FIG 1
FIG 2
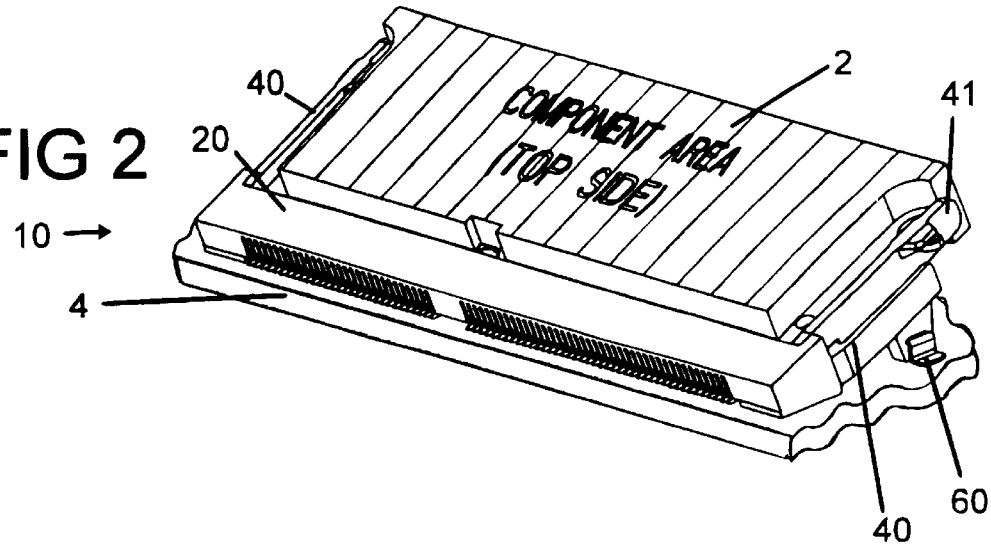

MEMORY MODULE SOCKET WITH ATTACHABLE LATCHING APPENDAGES

BACKGROUND OF THE INVENTION

1. Field of the Invention

A memory module socket for use in connecting and removing a memory module, such as a small outline dual in-line memory module is disclosed herein. This socket includes separate latches that can be attached to a main housing body to hold modules in place after they are cammed into the housing slot. Floating solder feet are used to attach the latches to the printed circuit board.

2. Description of the Prior Art

There are a number of prior art printed circuit board sockets that are used to mount single in line and dual in line memory modules on printed circuit boards.

Memory modules are typically mounted in conventional sockets of this type by inserting the card or board on which the electronic component is mounted into a housing slot that includes terminal contacts on at least one side of the housing slot. The module is then rotated into a final position deflecting the resilient contacts to impart a contact force to pads on the module card or board. U.S. Pat. No. 5,484,302 discloses a memory module socket including U-shaped metal latches that have been inserted into channels in molded guide arms located at opposite ends of a central housing having a card slot in which the module card card can be inserted. U.S. Pat. No. 5,863,213 discloses a dual in line memory module that has metal latches on either side of the card slot, which are mounted on the housing. These metal latches are inserted into the base of the housing and there are no molded guide arms extending from the housing base. This metal latch includes a solder foot or lug that is soldered to the printed circuit board on which the socket is mounted. A latching ledge or tab is located adjacent a distal end of a cantilever beam portion of the latch. This cantilever beam portion is outwardly deflectable during rotation of the module into place and during removal of the module from the socket. The cantilever beam portion is deflectable relative to that part of the latch that is soldered to the printed circuit board.

SUMMARY OF THE INVENTION

A socket for use with a memory module comprises a housing having a plurality of contacts arrayed along a housing slot. The socket, which in the preferred embodiment comprises a small outline dual in-line memory module socket provides for connection of the memory module, inserted into the housing slot, to a printed circuit board. The socket also includes latches attached to opposite ends of the housing. Latching surfaces on each latch engage the memory module remote from the housing slot. The latches attached to opposite ends of the housing are identical and are attached to the housing. Each identical latch includes a latch arm pivotal in opposite directions from a central neutral position, so that the identical latches can be assembled to both ends of the housing.

The preferred embodiment of the socket includes a solder foot attached adjacent to a distal end of each latch. The solder foot is used to attach the latch to the printed circuit board. Each solder foot is loosely held in an aperture on each latch so that the solder foot is free to float and to align itself with the printed circuit board. The solder foot thus retains the latches and the housing on the printed circuit board without applying stresses in the latches and the housing due to relative misalignment between the solder foot and the latch.

The small outline dual in line memory module socket, comprising the preferred embodiment of this invention, includes a pair of latching appendages press fit into a housing body configured to receive a dual in line memory module. The solder feet are snap fitted into each latching appendage adjacent a distal end thereof.

BRIEF DESCRIPTION OF THE DRAWINGS

FIG. 1 is a three dimensional view of a small outline dual in-line memory module socket according to the preferred embodiment of this invention.

FIG. 2 is a view of a memory module positioned in a small outline dual in-line memory module socket comprising the preferred embodiment of this invention.

DETAILED DESCRIPTION OF THE PREFERRED EMBODIMENT

Figure 3:
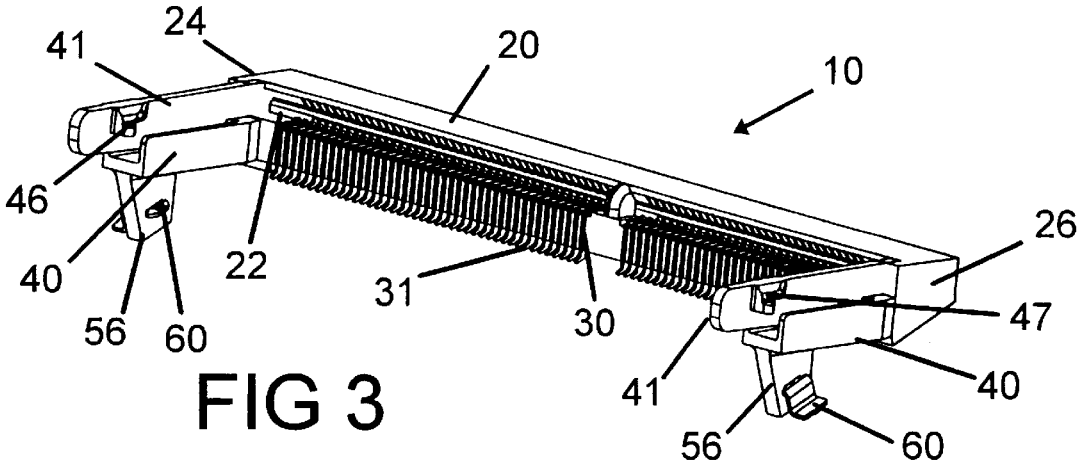
FIG. 3 is a view showing the housing slot in the small outline dual in-line memory module socket shown in FIGS. 1 and 2.
Figure 8:
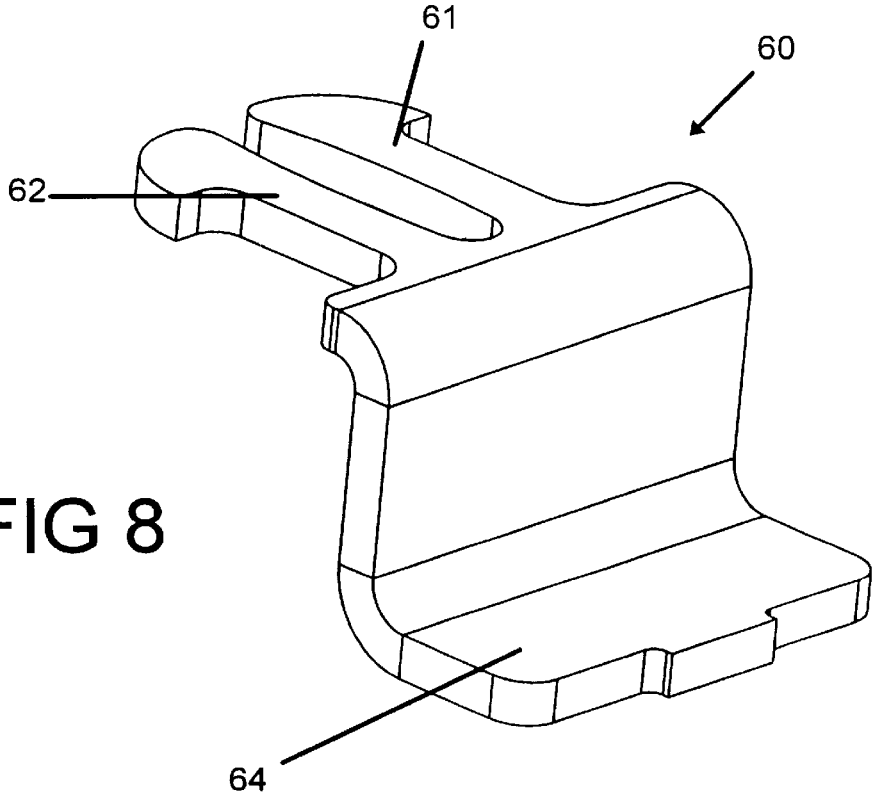
FIG. 8 is a view of the floating solder foot that is mounted on each latch as also shown in FIGS. 1–4.
Figure 4:
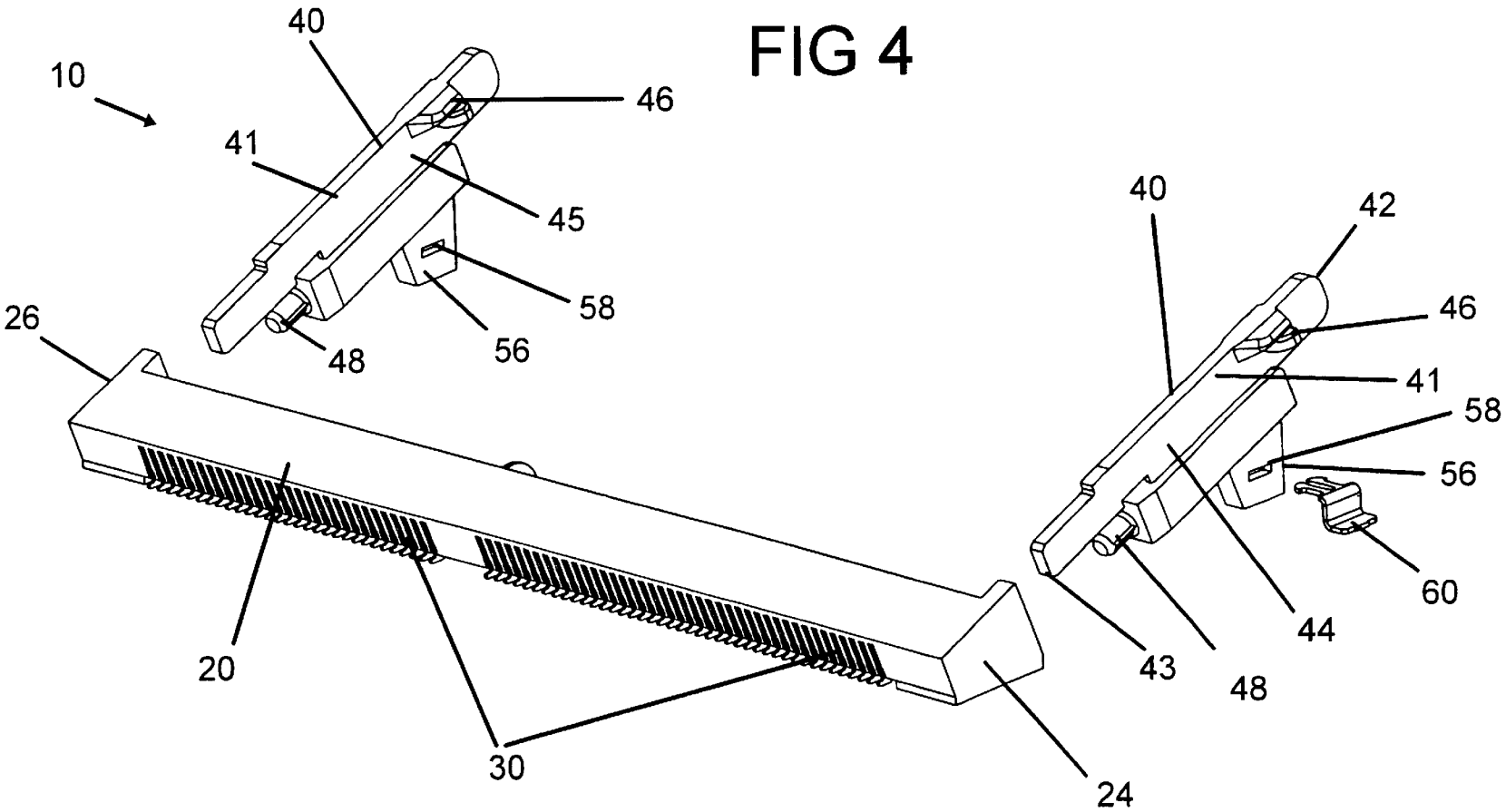
FIG. 4 is an exploded view showing two latches that are attached opposite ends of the socket housing.
Figure 5:
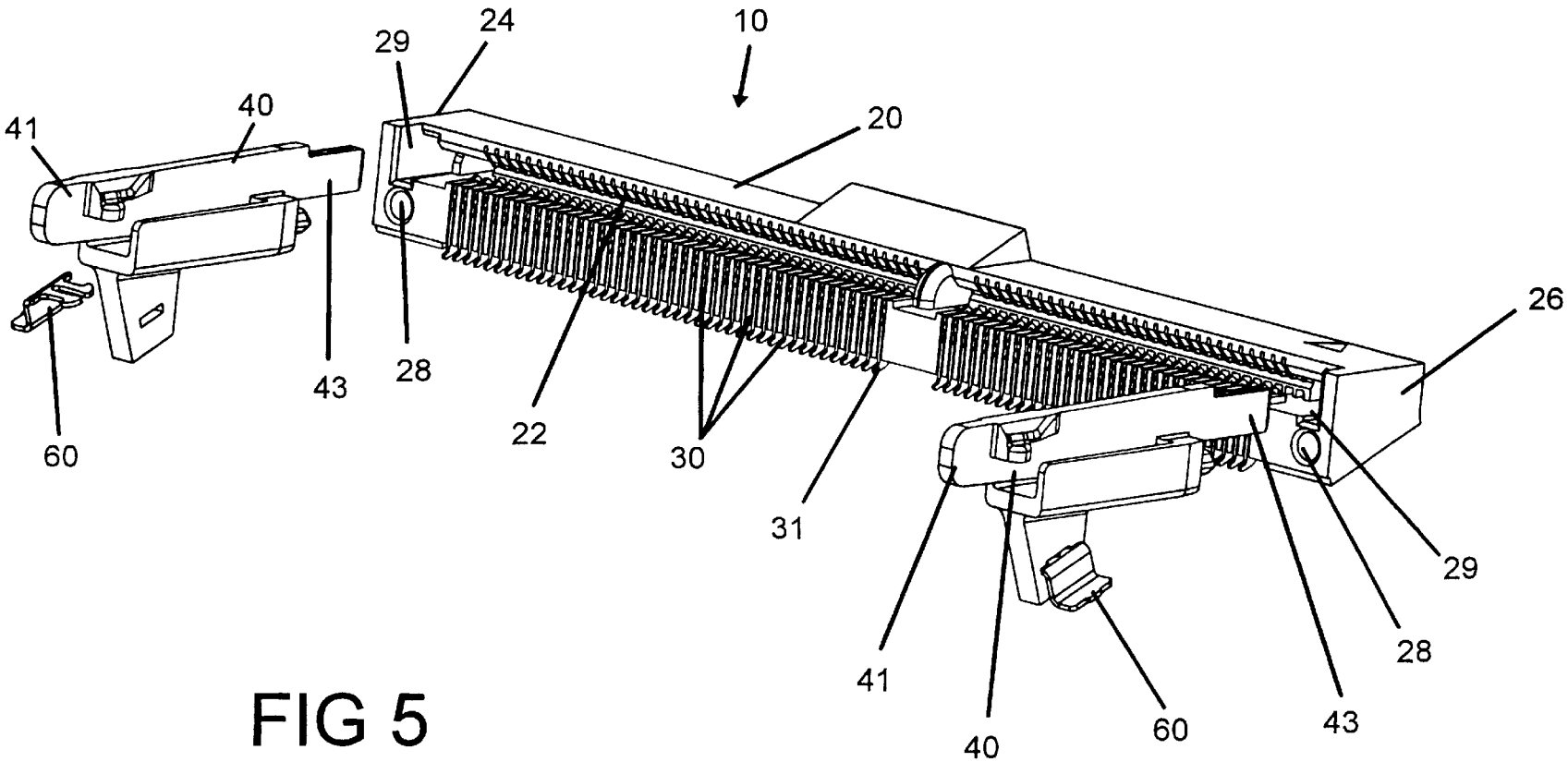
FIG. 5 is a view of housing slot side of the socket showing the pockets into which the latches are to be inserted.
Figure 6:
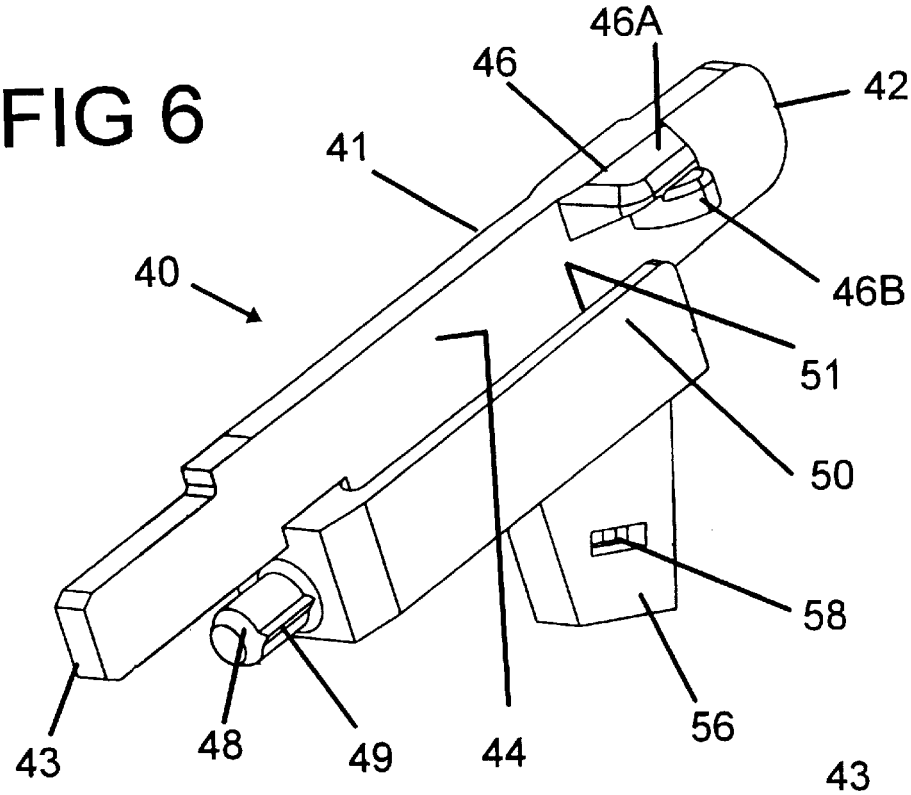
FIG. 6 is a three dimensional view of a single latch as seen from the base end of the latch that is to be attached to the socket housing.
Figure 7:
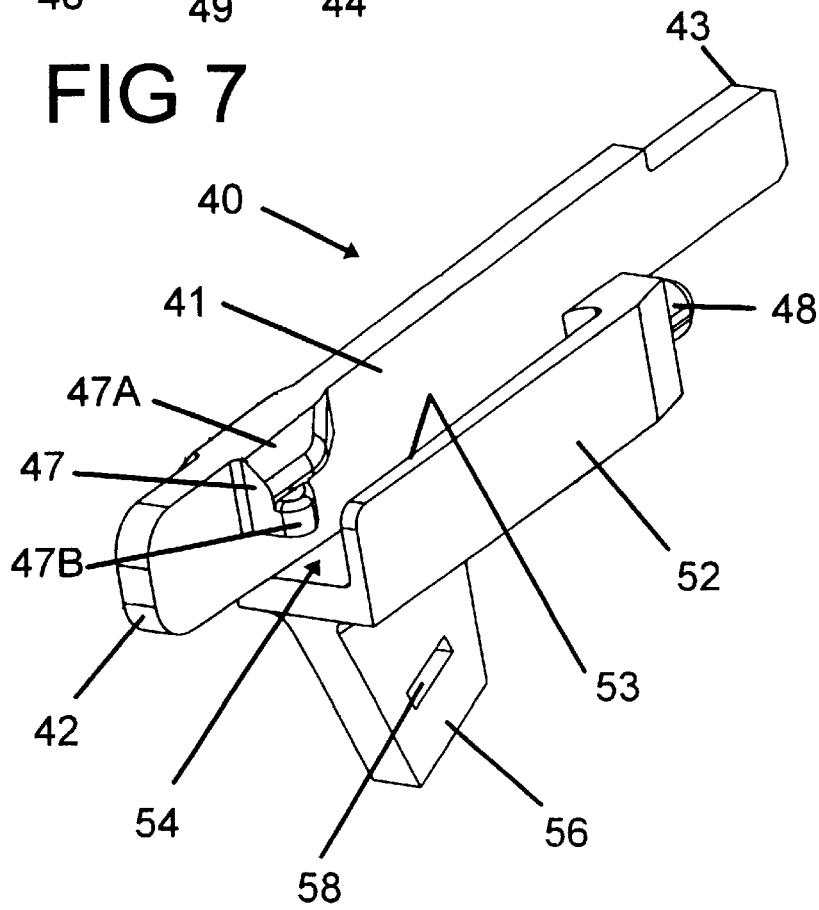
FIG. 7 is a three dimensional view of a single latch as seen from the distal or module latching end of the latch.
Figure 10:
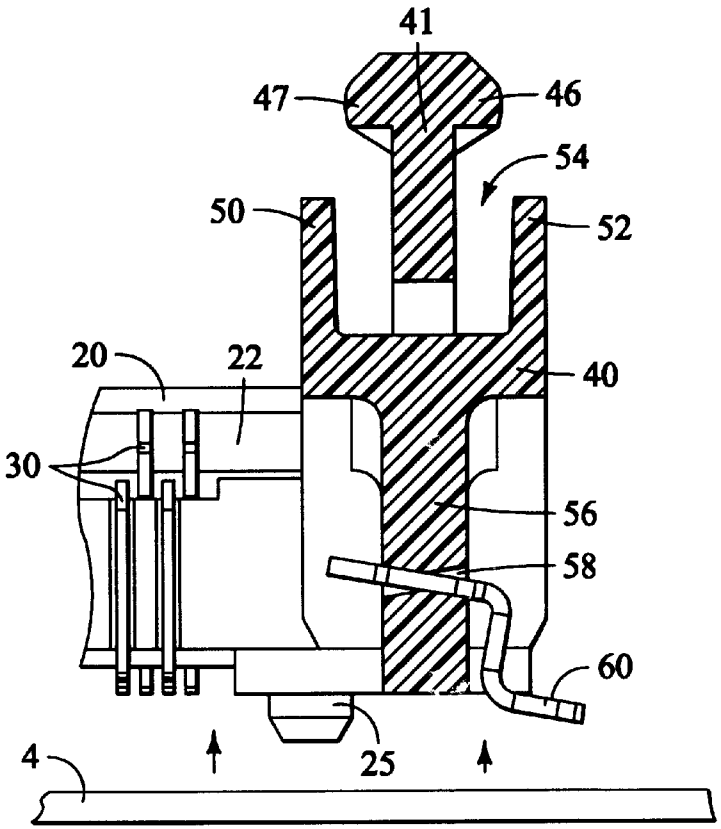
FIG. 10 is a section view taken along section lines 10—10 in FIG. 9 showing the manner in which the solder foot can float so that it can be properly soldered to a pad on the printed circuit board on which the socket is to be mounted.
Figure 9:
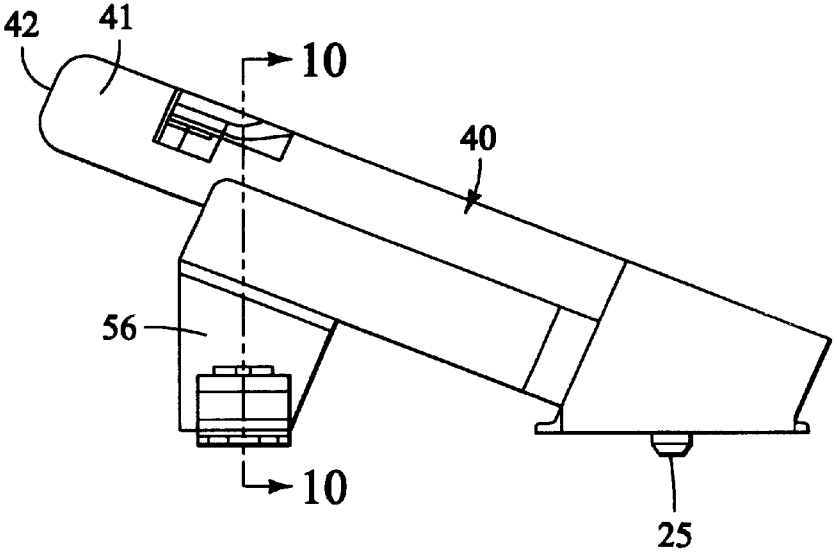
FIG. 9 is a side view of the latch with the solder foot positioned in the latch aperture.

Small Outline Dual In-Line Memory Module Sockets (SO DIMM) 10 are used to mount memory modules 2, such as SDRAM (Synchronous Dynamic Random Access Memory) and SGRAM (Synchronous Graphics Random Access Memory) on printed circuit boards 4. These sockets 10 permit easy alignment and cam in loading of modules 2 to permit upgrades to a computer or similar device or removal of and/or replacement of modules 2 as needed. These modules also allow mother boards and other board assemblies to be manufactured in a standard form and then to be customized or altered by the addition of memory modules 2.

SO DIMM Socket 20 comprises a housing or housing body 20 in which a plurality of surface mount contacts 30 are located on opposite sides of a housing slot 22 that extends the length of the housing 20 between a first housing end 24 and a second housing end 26. Sockets of this type typically include one hundred forty-four edged stamped contacts. Contacts 30 located on opposite sides of the slot 22 can thus contact traces or contact pads on opposite sides of a printed circuit card that forms a part of the memory module 2. These contacts 30 are of the type shown in U.S. Pat. No. 5,484,302 and in U.S. Pat. No. 5,863,213, which are incorporated herein by reference. It should be understood, however, that a single inline memory module (SIMM) socket could also employ the elements of this invention.

The housing 20 is molded from an insulating material and is mounted on a printed circuit board 4 and the contacts 30 are surface mount soldered to traces on the printed circuit board 4 by conventional means. Housing posts 25 are also inserted into holes on the printed circuit board to stabilize the board. The housing 20 employed in the preferred embodiment of this invention is intended to mount the module 2 at an angle of approximately 22.50 with respect to the plane of the printed circuit board 4 on which the socket is mounted. It should be understood, however, that alternate embodiments of this invention in which a socket would permit the module to be mounted parallel to the printed circuit boards, as shown in U.S. Pat. No. 5,484,302 and in U.S. Pat. No. 5,863,213, could also employ the elements of this invention.

The surface mount contacts 30 are inserted into cavities spanning the housing slot 22. In the preferred embodiment of this invention these contacts are stitched or loaded into the cavities in a high-speed assembly process. In order to simplify this assembly process, the housing 20 does not have any parts extending a significant distance from the housing so that they would interfere with this assembly step. Thus the molded housing 20 does not include latches molded as a part of the housing and extending from opposite ends of a onepiece housing. Instead separate module latches 40 are attached to opposite ends of the housing 20 and the housing slot 22 to hold the memory modules in place after they have been inserted and cammed into the housing slot 22. Although the advantages of attaching the latches to the housing 20 after insertion of the contacts 30 is important when used the contacts are stitched one at a time, it can also be used with a connector in which all of the contacts are gang loaded into the housing at the same time.

In the preferred embodiment, each latch or latching appendage 40 is a separate molded member that is press fit into engagement with the housing 20. Identical latches 40 can be assembled to opposite ends of the housing 20 and there is no need to fabricate individual right and left, or mirror image, latches on opposite housing ends 24, 26. By using identical latches only one mold need be fabricated, and it is not necessary to segregate and separately feed different latches into position as part of the assembly process.

Latches 40 include a flexible latch arm 41 which comprises a molded cantilever beam joined at the base of the beam to the body of the latch arm 41. The latch arm 41 is molded as part of the latch 40, but the latch arm 41 can be deflected from its neutral position in either a clockwise or a counterclockwise direction. Each latch arm 41 includes a first latching surface or clip 46 extending from its first side 44 and a second latching surface or clip 47 extending from its second side 45. Each latching clip or latching surface 46, 47 is located adjacent to the latch arm distal end 42. In the preferred embodiment the latching surfaces 46, 47 comprise identical, opposed molded protrusions on the sides of the latch arm. These latching surfaces have a shape that will engage conventional board lock and notch features on a standard memory module. Each latching surface 46, 47 is also located along the top edge of the latch arm 41 and comprises means for holding a memory module 2 in a latched position after it has been cammed into the housing slot 22. The latching surfaces 46, 47 will overlap a portion of the top surface of the memory module 2 to resist the force imparted to the module by the deflection of the contacts 30 required to generate a mating force between the contacts 30 and pads on the module board. In other words, the latches 41 and the latching surfaces 46, 47 will prevent the cammed in module 2 from rotating out of engagement with the contacts 30. Of course only the interior one of the latching surfaces 46, 47 will engage the module 2. However, by including latching surfaces 46, 47 on both sides of the latch arm 41, the same latch 40 can be used on both housing ends 24, 26. On the right housing end 24, the left latching surface 47 will engage the board of the module 2, and on the left housing end 26, the right latching surface 46 will engage the board of the module 2.

The latch arm 41 is located partially within a channel 54 extending along the top of the latch 40. his channel 54 is formed by a first stop wall 50 and a second stop wall 52, both of which extend upwardly from the bottom surface 55 of the channel 54. The latch arm is joined to the proximate end of the channel 54, and the latch arm 41 extends above the top edges 51, 53 of stop walls 50, 52 respectively. The latching surfaces or clips 46, 47 are also located above the wall top edges 51, 53. In the preferred embodiment of the invention the latching surfaces 46, 47 are spaced above the stop wall top edges 51, 53 by a distance approximately equal to the thickness of a printed circuit board (not shown) which forms a conventional part of the module 2 and on which the conventional module contact pads (also not shown) are located. The stop walls 50, 52 and their top edges 51, 53 can thus serve as supporting surfaces for a module 2 that is latched to the socket 10. The stop walls 50, 52 also comprise positive stops that will prevent excess deflection of the latch arm 41 in either direction so that the latch arm will be deflected when the modules is cammed into the housing slot 22 or when the latch arms 41 are intentionally deflected to release the latching surfaces 46, 46 from the board of module 2 so that the module can be released or extracted from the socket. The tops of latching surfaces 46, 47 are also gently outwardly tapered so that insertion of the module 2 will cause outward deflection of the latch arms 14 on opposite ends of the socket housing 2 as the module 2 is cammed into its fully loaded configuration. Alternatively, an installer can simply press outward on the distal ends 42 of the latch arms 41 as the module 2 is cammed into position.

The latches 40 are attached to the housing body 20 by inserting a post or latch arm extension 48 into holes or press fit recesses 28 located on opposite ends of the housing slot 22. Each post 48 includes deformable press fit ridges 49 or protruding sections extending axially along the exterior of the post 48. These ridges 49 are deformed when the post 48 is inserted into a companion press fit hole 28 to establish an interference fit which will prevent removal of the latch 40 from the housing 20. The proximate end of the latch 40 also includes a rectangular base end which is inserted into a companion groove 29 on the inner side of the housing 20 to stabilize the latch arm 40. Grooves 29 communicate with the housing slot 22 and comprise end sections of that slot having height that is greater than the height or transverse dimension of the housing slot 22.

Each latch 40 is angled so that the module 2 will be tilted at an angle relative to the printed circuit board 4. This orientation of the module 2 permits easy access to the modules for insertion and removal even when the modules are tightly packed while at the same time reducing the distance by which the module 2 will extend above the printed circuit board 4. A flat rib or support member 56 extending downwardly from the channel 54 positions the latches 40 in the angled or tilted configuration. The rib 56 is centrally located relative to the channel 54 and to the entire latch 40 so that the position of the latch 40 and latching surfaces 46, 47 relative to the housing slot 22 and to the module 2 will be the same when identical latches are attached to either housing end 24, 26.

The flat support ribs 56 also include a rectangular aperture 58 extending between opposite sides of the support rib. A solder foot 60, which comprises means for attaching the socket 10 and the latch 40 to the printed circuit board 4, is mounted in this aperture 58.

Both solder feet 60 on the same socket are not rigidly attached to the latch 40. Each solder foot 60 is free to float so that the solder foot 60 will rotate to a position in which the solder foot surface mount contact section 64 is parallel to the contact pad or trace on the printed circuit board 4 to which the solder foot 60 is to be attached. Thus the position of the solder foot 60 is not affected by any lack of co-planarity between the socket 10 and the printed circuit board 4. Any warpage of the molded connector housing or the printed circuit board will not affect the relative position between the solder foot surface mount contact section 64 and the pad to which it is to be soldered. Stresses will therefore not be induced in the housing 20, the printed circuit board 4 of the solder joints formed between the contacts 30 and corresponding printed circuit board contacts or between the solder feet 60 and their corresponding printed circuit board pads. Not only are any initial stresses due to warpage or initial lack of co-planarity of cooperating component that may be present when the socket is mounted on the printed circuit board, but also any stresses that may be introduced during the life of the socket 10 and module 2, due to thermal cycling and the different coefficients of thermal expansion of the individual components and assemblies. In addition the floating solder foot 60 will contact a pad on the printed circuit board when a socket 10 is mounted using pick and place equipment. Typically this type of equipment will not press the socket 10 or the solder foot 60 into engagement with the printed circuit board or the solder pad on the board. Thus if the solder foot 60 does not engage a corresponding solder pad, then a solder joint will not form. However, since the solder foot 60 is free to float, it will engage the pad even when the printed circuit board or the socket housing is warped or when there is a lack of coplanarity for any reason. It should also be understood that the solder foot 60 on a latch 40 one end of the socket 10 need not be oriented in the same precise manner as the solder foot 60 on the other latch 40 attached to the other end of the housing 20. Indeed it would not be uncommon for a printed circuit board to be warped and a printed circuit board pad to be soldered to one solder foot 60 at one end of the housing 20 to be located in a slightly different plane than one at the opposite end because the printed circuit board itself would not be flat.

Solder foot 60 includes two bifurcated beams 61, 62 located on an end of the solder foot 60 and extending in a plane offset relative to the solder foot contact section 64. These beams include tabs at the free ends with a slot extending between the beams 61, 62. The ends of the beams are tapered so that the solder foot can be mounted on the support rib 56 of the latch 40 by inserted the bifurcated attachment beams 61, 62 in the rectangular aperture 58. The solder foot 60 can be inserted into the aperture 58 from either side of the rib 56 so that the surface mount contact sections will be properly aligned with the corresponding contact pads. In the preferred embodiment, the floating solder foot 60 would be inserted into the aperture 58 from the outside of the latch rib 56, so that surface mount contact sections 64 would both be located on the outer sides of the ribs 56. To permit each solder foot 60 to float freely, the width of the combined solder foot beams 61, 62 or the distance between outer edges, when the beams are in a neutral, unstressed condition, will be less than the width of the aperture 58 to provide sufficient clearance to permit the solder foot 60 move within the aperture 58 and relative to the corresponding latch 40.

The embodiment of this invention depicted herein is representative of other sockets including equivalent structures that would be apparent to one of ordinary skill in the art. For example, instead of molding each latch, the latch could comprise a composite structure in which a spring metal latch arm is mounted in a plastic latch support that would in turn be attached to the housing. This alternative embodiment is merely one optional equivalent structure that would be apparent to one of ordinary skill in the art. Furthermore this invention is not limited to use with single outline dual in line memory module sockets or to tilted versions of a socket of that type. Therefore, the embodiment shown herein is representative and the subject matter of this invention is as defined by the following claims.

I claim:

1. A socket for use with a memory module comprising a housing having a plurality of contacts arrayed along a housing slot to comprise means for connection of the memory module, inserted into the housing slot, to a printed circuit board, the socket also including:

latches attached to opposite ends of the housing by a press fit interaction of a post on each latch with a respective hole in the housing and including latching surfaces for engaging the memory module remote from the housing slot, the latches attached to opposite ends of the housing being identical, each identical latch including a channel with a support member extending centrally from a bottom surface of the channel and a latch arm extending partially into the channel and being pivotal in opposite directions from a central neutral position by urging a distal end thereof, so that the identical latches can be assembled to both ends of the housing.

2. The socket-of claim 1 wherein the latch includes a stop member limiting the travel of the latch arm.

3. The socket of claim 2 wherein walls comprising stop members are located on opposite sides of the latch arm to limit travel of the latch arm in opposite directions.

4. The socket of claim 3 wherein the latch arm comprises a cantilever beam positioned between two walls of the channel forming stop members.

5. The socket of claim 4 wherein a top edge of each wall is located to a side of the latch arm, a top surface of each wall comprising means for supporting a module printed circuit board inserted in the housing slot.

6. The socket of claim 1 wherein each latch arm includes latching surfaces on opposite sides thereof.

7. The socket of claim 1 wherein each latch is attached to the housing to support the housing in a tilted position relative to the printed circuit board.

8. The socket of claim 1 wherein the support member includes an aperture into which a solder foot extends to support the solder foot for soldering to the printed circuit board.

9. The socket of claim 1 wherein each latch comprises a molded member attached to a molded housing.

10. The socket of claim 1 wherein the latch includes a base end inserted into a groove communicating with the housing slot.

* * * * *